US012654826B2

(12) United States Patent
Faizan et al.

(10) Patent No.: US 12,654,826 B2
(45) Date of Patent: Jun. 16, 2026

(54) FLOATATION DEVICE

(71) Applicant: Mirza Faizan, Irving, TX (US)

(72) Inventors: Mirza Faizan, Irving, TX (US); Advaita Piduri, Plano, TX (US); Rashi Sharma, Frisco, TX (US); Ayushi Gopal, Keller, TX (US); Haroon Khan, Murphy, TX (US); Alisha Shadab, Irving, TX (US); Simran Babaria, Frisco, TX (US); Aaina Mitchell, Irving, TX (US); Reyansh Kumar Singh, Frisco, TX (US); Hisham Ahmad, Allen, TX (US); Saadia Asaf, Aligarh (IN); Mansoor Hasan Khan, Aligarh (IN); Mirza Rizwan, Patna (IN); Ashaz Haque, Patna (IN); Aarifa Fatima, Patna (IN); Ayaan Ahmed, Allen, TX (US); Aliza Asim, Allen, TX (US)

( * ) Notice: Subject to any disclaimer, the term of this patent is extended or adjusted under 35 U.S.C. 154(b) by 281 days.

(21) Appl. No.: 18/648,839

(22) Filed: Apr. 29, 2024

(65) Prior Publication Data

US 2025/0333150 A1 Oct. 30, 2025

(51) Int. Cl.
*B63C 9/125* (2006.01)
*B63C 9/00* (2006.01)
(Continued)

(52) U.S. Cl.
CPC ..... *B63C 9/1255* (2013.01); *B63C 9/20* (2013.01); *B63C 2009/0047* (2013.01); *B63C 9/155* (2013.01); *B63C 9/18* (2013.01)

(58) Field of Classification Search
CPC ..... B63C 9/1255; B63C 9/155; B63C 9/18; B63C 9/20; B63C 2009/0047
See application file for complete search history.

(56) References Cited

U.S. PATENT DOCUMENTS 476,277 A * 6/1892 Krieg ..... B63C 9/115 137/540
1,081,520 A * 12/1913 Sommerfeld ..... B63C 9/1255 441/111

(Continued)

FOREIGN PATENT DOCUMENTS

CN 109436250 A * 3/2019 ..... B63C 9/18
CN 119099819 A * 12/2024 ..... B63C 9/18

(Continued)

*Primary Examiner* — Christopher R Harmon

(57) ABSTRACT

Embodiments of a floatation device floatation assistance with an advanced safety mechanism are provided. The floatation device comprises a frustoconical floatation member defining a cavity to receive a lower region of a wearer. The floatation device comprises a pair of straps having a first end and an opposing second end. The floatation device further comprises an inflatable annular strap. The annular strap comprising an inflation mechanism and at least a water level sensor to measure a water level data and an inclination sensor to measure inclination data. The floatation device further comprises a memory to store instructions, and a processor. The processor is configured to receive the water level data and the inclination data, determine whether the wearer is drowning based on the water level data and the inclination data, and trigger the inflation mechanism to inflate the annular strap based on determining that the wearer is drowning.

20 Claims, 7 Drawing Sheets

(51) Int. Cl.

| | |
|---|---|
| ***B63C 9/15*** | (2006.01) |
| ***B63C 9/18*** | (2006.01) |
| ***B63C 9/20*** | (2006.01) |

(56) References Cited

U.S. PATENT DOCUMENTS

| | | | | |
|---|---|---|---|---|
| 1,538,484 | A * | 5/1925 | Hahn | B63C 9/24<br>251/354 |
| 2010/0227518 | A1 * | 9/2010 | Ware | B63C 9/22<br>441/80 |

FOREIGN PATENT DOCUMENTS

| | | | | |
|---|---|---|---|---|
| ES | 2351561 | A1 * | 2/2011 | B63C 9/18 |
| WO | WO-2014076685 | A1 * | 5/2014 | B63C 9/1255 |

* cited by examiner

FLOATATION DEVICE

TECHNOLOGICAL FIELD

The disclosure relates to floatation devices for assisting in floatation, and more particularly to float devices, system, and method for assisting in floatation on surface of water.

BACKGROUND

Water-based recreational activities, such as swimming, boating, and water sports offer enjoyable experiences and relaxation for individuals of all ages. However, these activities also carry inherent risks, particularly the danger of drowning. Therefore, ensuring safety in aquatic environments, especially for persons with limited swimming skills, remains a concern. Moreover, when considering water safety, the risks for children are particularly concerning due to their vulnerability and limited ability to recognize and respond to potential dangers.

Traditional floatation devices (or floats) have served as safety tools by providing buoyancy to keep individuals afloat in water. While the traditional floats are effective to some extent, they often possess limitations that compromise their overall safety and usability. The traditional floats predominantly adhered to passive design principle, offering limited adaptability to changing water conditions or immediate response mechanism.

Furthermore, traditional floats have struggled to provide a secure and tailored fit for users of varying ages and sizes. In addition, the traditional floats may suffer from instability, especially in turbulent waters or during sudden movements, posing a risk of overturning or submersion. Additionally, conventional designs may lack adequate buoyancy distribution, leading to uneven floatation and potential difficulties in maintaining a proper position in the water. Furthermore, many floats are bulky and restrictive, hindering movement and causing discomfort, which may discourage their consistent use.

In light of the shortcomings of the traditional floats, there is a need for an improved float device that provides enhanced safety, stability, and comfort for users engaging in water activities.

SUMMARY

Embodiments of the present disclosure provide a floatation device, a method, and a system for floatation assistance with an advanced safety mechanism that responds dynamically for ensuring safety of a wearer.

Accordingly, in one aspect, the present disclosure provides a floatation device. The floatation device comprises a frustoconical floatation member defining a cavity to receive a lower region of a wearer, the floatation member having a top end and a bottom end opposite to the top end. The floatation device comprises a pair of straps having a first end and an opposing second end. The first end is connected to the first side of the top end and the second end is connected to a second side of the top end. The first side is opposite the second side. The floatation device further comprises an inflatable annular strap to extend around an upper region of the wearer. The annular strap comprising an inflation mechanism and at least a water level sensor to measure a water level data and an inclination sensor to measure inclination data. The floatation device further comprises a memory to store instructions. The floatation device comprises a processor connected to the water level sensor and the inclination sensor. The processor is configured to execute the instructions to receive the water level data and the inclination data. Further, the processor is configured to determine whether the wearer is drowning based on the water level data and the inclination data. Further the processor is configured to trigger the inflation mechanism to inflate the annular strap based on determining that the wearer is drowning.

In additional device embodiments, the annular strap further comprises a displacement sensor to measure displacement data, and the processor is configured to determine whether the wearer is drowning based on the displacement data.

In additional device embodiments, the circumference of the top end is smaller than the circumference of the bottom end, and the upper region of the wearer is closer to the top end than the bottom end.

In additional device embodiments, the floatation device further comprises a divider extending along a diameter of the cavity and coupled to the floatation member. The divider divides the cavity into two halves.

In additional device embodiments, the frustoconical floatation member defines the cavity to receive legs of the wearer.

In additional device embodiments, the inflatable annular strap extends around the chest of the wearer.

In additional device embodiments, the pair of straps is adapted to be adjustably supported on shoulders of the wearer to secure the floatation member to the wearer.

In additional device embodiments, the processor is configured to determine at least one of: a level of water in contact with the wearer based on the water level data, or an inclination of the wearer relative to a vertical position based on the inclination data.

In additional device embodiments, the processor is configured to perform at least one of: a comparison between the level of water in contact with the wearer and a first threshold, or a comparison between the inclination of the wearer and a second threshold. Further the processor is further configured to determine whether at least one of: the level of water is greater than the first threshold, or the inclination is greater than the second threshold, based on the comparison. The processor is further configured to trigger the inflation mechanism to inflate the annular strap based on the determination and a predefined time threshold.

In additional device embodiments, the annular strap further comprises an alert mechanism. The processor is configured to trigger the alert mechanism based on the triggering of the inflation mechanism.

In additional device embodiments, the alert mechanism is based on at least one of: visual alert mechanism, or audio alert mechanism.

In another aspect, a method for floatation assistance is disclosed. The method is implemented using a floatation device comprising a frustoconical floatation member defining a cavity to receive a lower region of a wearer, the floatation member having a top end and a bottom end opposite to the top end. The floatation device comprises a pair of straps having a first end and an opposing second end. The first end is connected to a first side of the top end and the second end is connected to a second side of the top end, and the first side is opposite to the second side. The floatation device comprises an inflatable annular strap to extend around an upper region of the wearer, the annular strap comprising an inflation mechanism and at least a water level sensor to measure a water level data and an inclination sensor to measure inclination data. The method comprises receiving the water level data from the water level sensor and the inclination data from the inclination sensor. The method comprises determining whether the wearer is drowning based on the water level data and the inclination data. further the method comprises triggering the inflation mechanism to inflate the annular strap based on determining that the wearer is drowning.

In yet another aspect, a system for floatation assistance is disclosed. The system comprises a memory for storing instructions. The system comprises a processor configured to the execute the instructions that cause the processor to receive water level data from a water level sensor and inclination data from an inclination sensor. The water level sensor and the inclination sensor are provided in an inflatable annular strap of a floatation device that extends around an upper region of a wearer. The annular strap comprises an inflation mechanism, and the floatation device comprises a frustoconical floatation member having a top end and a bottom end opposite to the top end and defining a cavity to receive a lower region of the wearer, and a pair of straps having a first end and an opposing second end such that the first end is connected to a first side of the top end and the second end is connected to a second side opposite to the first side of the top end. Further the processor is configured to determine whether the wearer is drowning based on the water level data and the inclination data. the processor is further configured to trigger the inflation mechanism to inflate the annular strap based on determining that the wearer is drowning.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Figure 1:
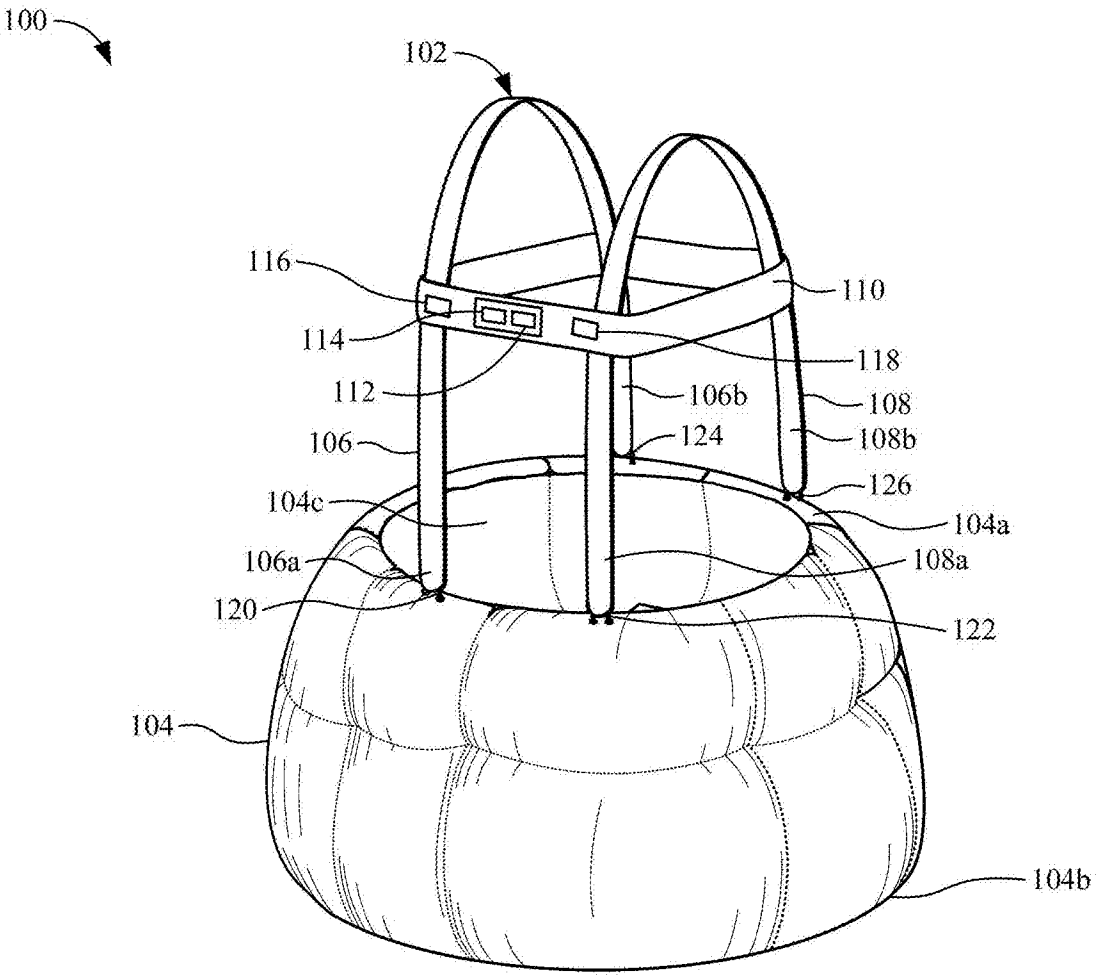
Figure 2:
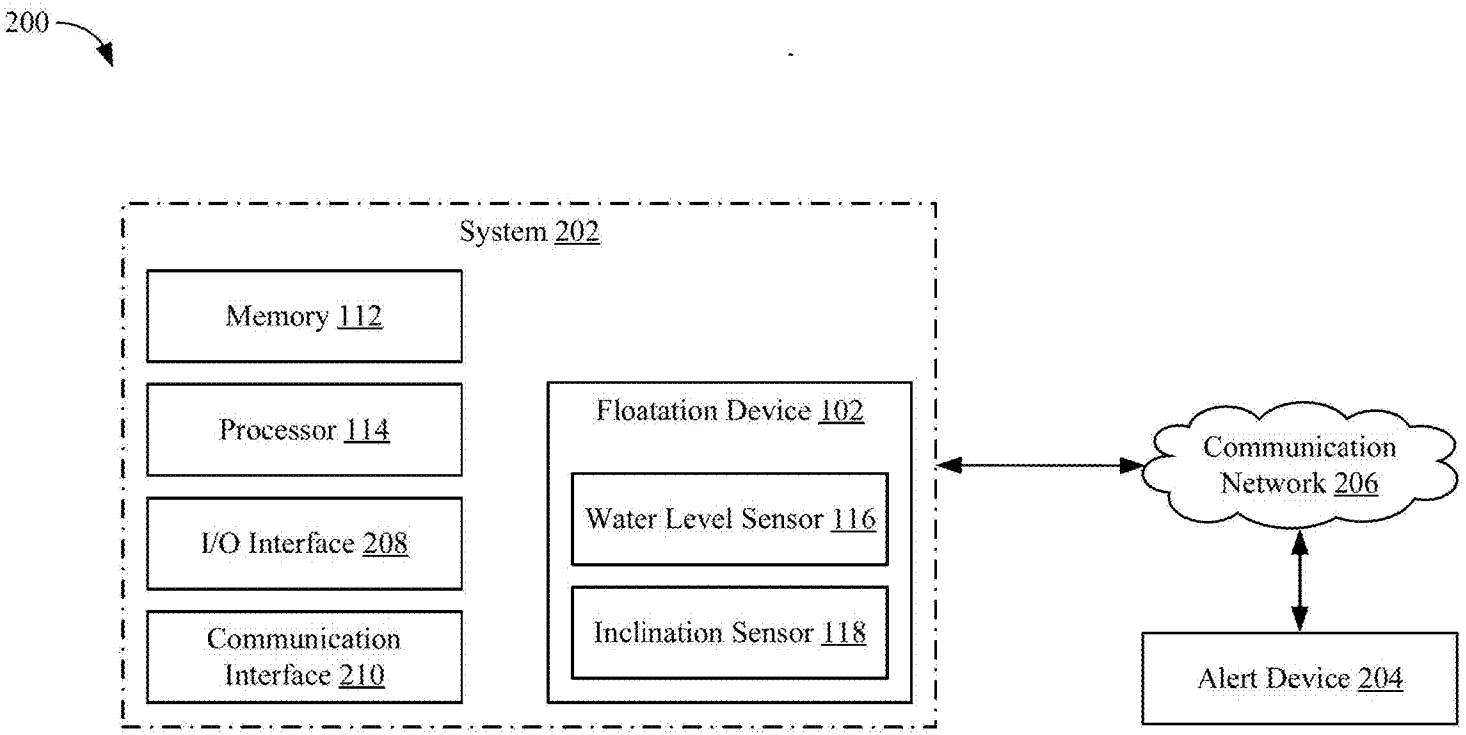
Figure 3B:
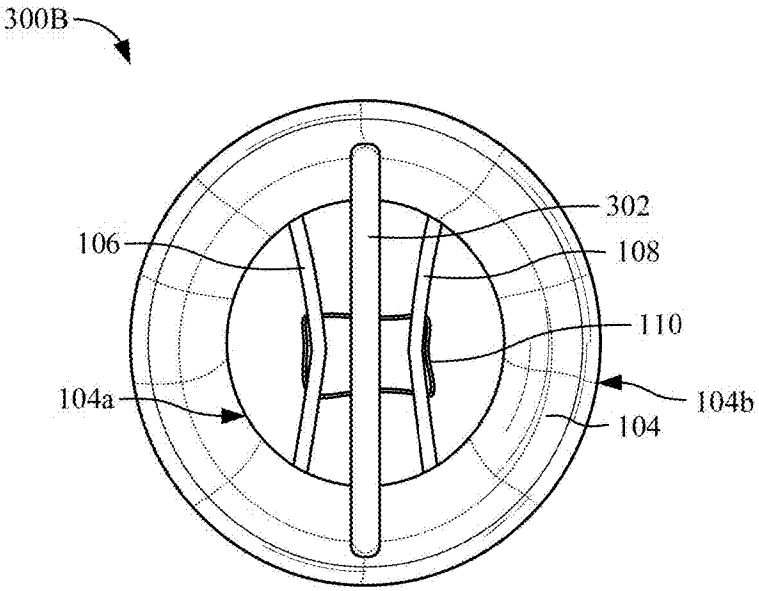
Figure 3A:
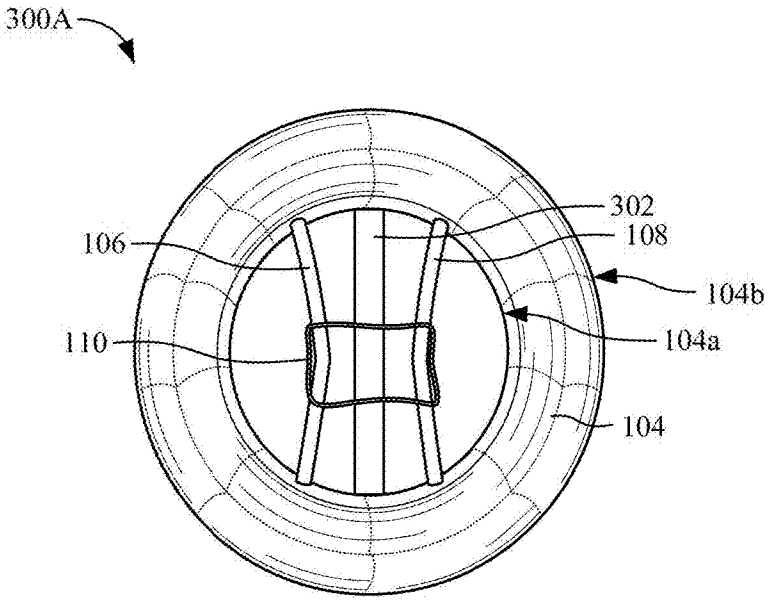
Figure 4A:
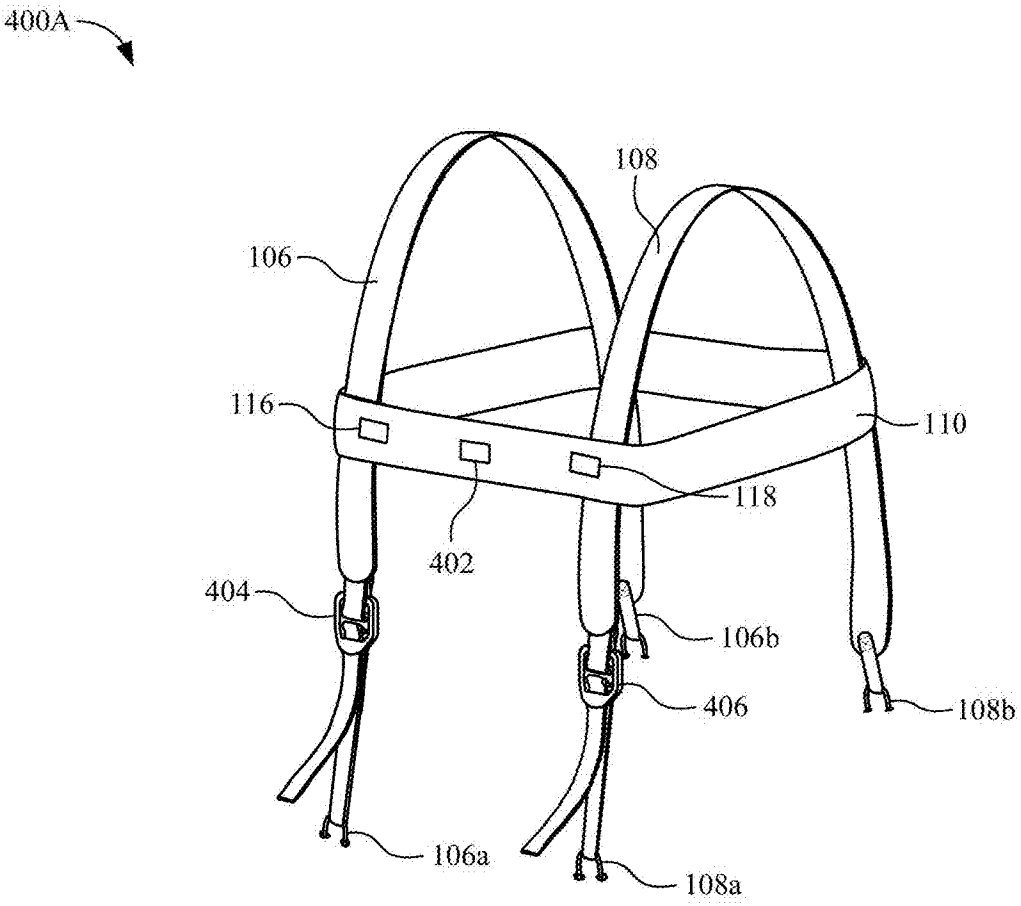
Figure 4B:
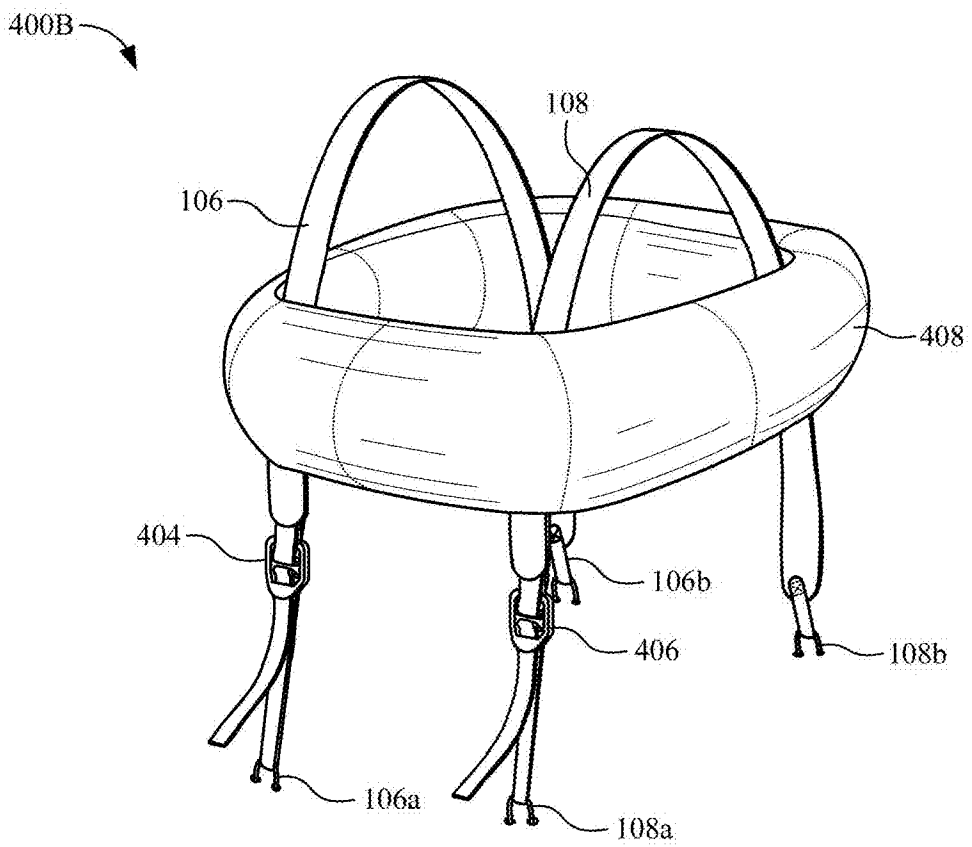
Figure 5:
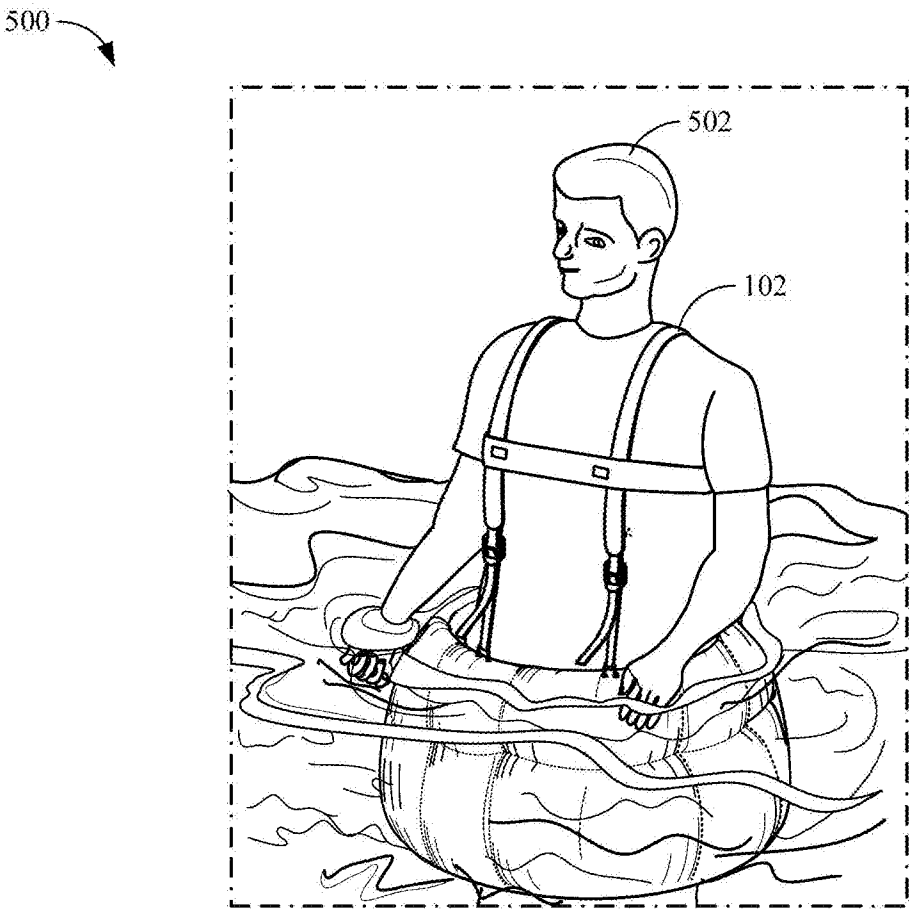
Figure 6:
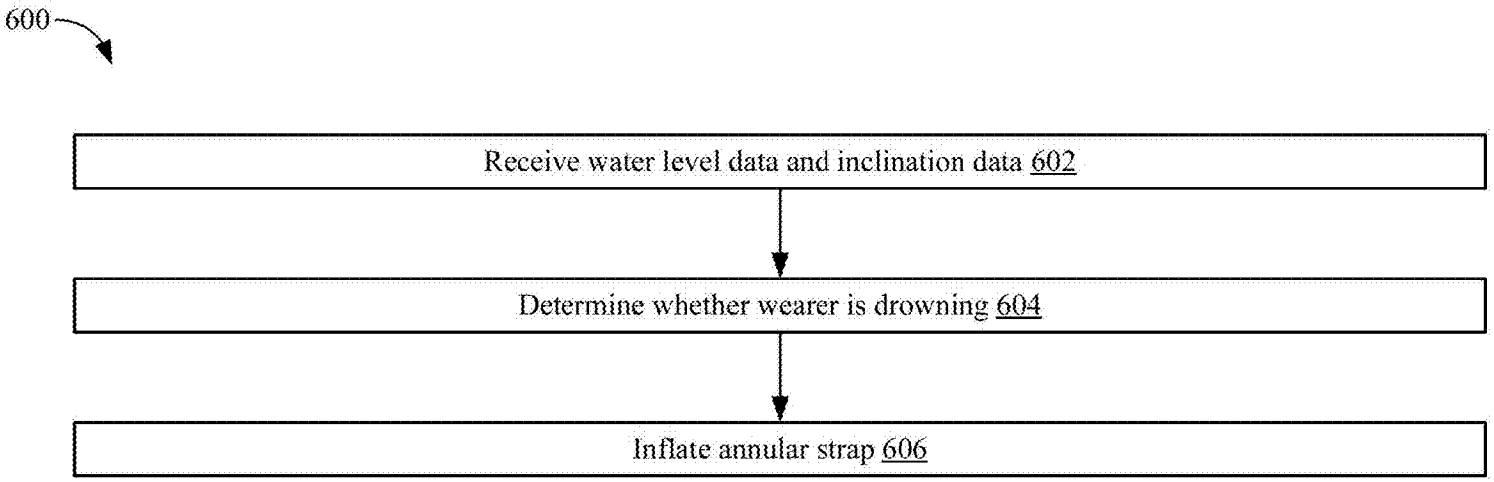

Having thus described example embodiments of the invention in general terms, reference will now be made to the accompanying drawings, which are not necessarily drawn to scale, and wherein:

FIG. 1 is a schematic illustration of a perspective view of a floatation device, in accordance with an example embodiment of the present disclosure;

FIG. 2 is a schematic illustration of a network environment in which a system for floatation assistance is implemented, in accordance with an example embodiment of the present disclosure;

FIG. 3A is a schematic illustration of a top view of the floatation device, in accordance with an example embodiment of the present disclosure;

FIG. 3B is a schematic illustration of a bottom view of the floatation device, in accordance with an example embodiment of the present disclosure;

FIG. 4A and FIG. 4B are schematic illustrations of an inflatable annular strap of the floatation device, in accordance with an example embodiment of the present disclosure;

FIG. 5 is a schematic illustration of the floatation device when in use, in accordance with an example embodiment of the present disclosure; and FIG. 6 is a flowchart of a method for providing floatation assistance, in accordance with an example embodiment of the present disclosure.

DETAILED DESCRIPTION

In the following description, for purposes of explanation, numerous specific details are set forth in order to provide a thorough understanding of the present disclosure. It will be apparent, however, to one skilled in the art that the present disclosure may be practiced without these specific details. In other instances, systems and methods are shown in block diagram form only in order to avoid obscuring the present disclosure.

Some embodiments of the present disclosure will now be described more fully hereinafter with reference to the accompanying drawings, in which some, but not all, embodiments of the disclosure are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout. Also, reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect. Turning now to FIG. 1-FIG. 6, a brief description concerning the various components of the present disclosure will now be briefly discussed. Reference will be made to the figures showing various embodiments of a device for floatation assistance with an advanced safety mechanism that responds dynamically to ensuring the safety of a wearer.

FIG. 1 is a schematic illustration 100 of a perspective view of a floatation device 102, in accordance with an example embodiment of the present disclosure. The floatation device 102 is operable to assist a wearer in staying afloat and maintain buoyancy in water. The floatation device 102 is operable to enhance water safety during activities, for example, but not limited to swimming, rafting, kayaking, surfing, parasailing, and boating. The floatation device 102 may be made of buoyant materials. The floatation device 102 may provide additional support and prevent the wearer from drowning.

The floatation device 102 includes a frustoconical floatation member 104, a pair of straps (depicted as straps 106 and 108), an inflatable annular strap 110, a memory 112 and a processor 114. Further, the inflatable annular strap 110 may include a water level sensor 116, an inclination sensor 118.

The frustoconical floatation member 104 (referred to as floatation member 104, hereinafter) is a lower part of the floatation device 102. The floatation member 104 defines a cavity 104*c* to receive a lower region of a wearer. In particular, the flotation member 104 has a top end 104*a* and a bottom end 104*b* opposite to the top end 104*a*. Particularly, the floatation member 104 is a hollow frustum with openings on both the opposing bases, i.e., the top end 104*a* and the bottom end 104*b*. Subsequently, the floatation member 104 defines the cavity 104*c* to receive the lower region of a wearer. For example, when worn, the floatation member 104 may be positioned around a waist or an abdominal segment of the wearer.

In an embodiment, a circumference of the top end 104*a* is smaller than a circumference of the bottom end 104*b*. For example, the upper region of the wearer is closer to the top end 104*a* than the bottom end 104*b*. Subsequently, the floatation member 104 may have a smaller circumference at the top end 104*a* than that of the bottom end 104*b* creating the frustoconical shape. The frustoconical shape aligns with the wearer's anatomy, ensuring a more tailored and secure fit and enhances both buoyancy and user comfort during aquatic activities.

In an example, the flotation member 104 defines the cavity 104*c* to receive legs of the wearer. The cavity 104*c* of the floatation member 104 may provide a secure and supportive fit around the lower region of the wearer, ensuring that the floatation device 102 remains snugly positioned during water activity, for example, swimming. The floatation member 104 offers stability and buoyancy in the water.

The floatation device 102 includes the pair of straps 106 and 108. In an example, the straps 106 and 108 may be long bands of fabric or material that extend over the shoulders and connect the first side and the second side of the floatation member 104. For example, the straps 106 and 108 may hold the floatation member 104 on the body of the wearer in a desired position. The straps 106 and 108 may be adjustable to accommodate different body sizes and preferences for fit.

According to the present disclosure, the straps 106 and 108 have a first end and an opposing second end. For example, the strap 106 has a first end 106*a* and a second end 106*b*, and the strap 108 has a first end 108*a* and a second end 108*b*. Moreover, the first ends, i.e., the first end 106*a* of the strap 106 and the first end 108*a* of the strap 108, are connected to a first side of the top end 104*a*. Further, the second end, i.e., the second end 106*b* of the strap 106 and the second end 108*b* of the strap 108, are connected to a second side of the top end 104*a*. For example, the first end 106*a* of the strap 106 is connected to the first side at 120 and the first end 108*a* of the strap 108 is connected to the first side at 122. The second end 106*b* of the strap 106 is connected to the second side at 124 and the second end 108*b* of the strap 108 is connected to the second side at 126. The first side is opposite the second side. For example, the first side of the top end 104*a* may be a front side of the floatation member 104 and the first side of the top end 104*a* may be a back or rear side of the floatation member 104, or vice versa.

For example, the pair of straps 106 and 108 is adapted to be adjustably supported on shoulders of the wearer to secure the flotation member 104 to the wearer. When worn, the straps 106 and 108 may extend from front side of the lower region, such as the waist or abdominal segment to back side of the lower region, such as the waist or lower back of the wearer. Subsequently, the straps 106 and 108 are supported on the shoulders of the wearer. In this manner, the straps 106 and 108 may secure the flotation member 104 on the body of the wearer.

Further, the floatation device 102 includes the inflatable annular strap 110 (referred to as annular strap 110, hereinafter). The annular strap 110 extends around an upper region of the wearer. The annular strap 110 is connected to the straps 106 and 108, such that the annular strap 110 is transversal to the straps 106 and 108. The annular strap 110 defines a circular opening to extend around the upper region of the wearer. For example, when worn, the annular strap 110 is positioned encircling a chest of the wearer, creating a secure and encompassing structure around upper torso of the wearer.

Continuing further, the annular strap 110 includes the water level sensor 116 and the inclination sensor 118. The annular strap 110 also includes an inflation mechanism.

The water level sensor 116 is configured to measure real-time water level data surrounding the wearer. The water level data may indicate a level of water or liquid surrounding the wearer. In an example, a working principle of the water level sensor 116 is that the water level sensor 116 positioned or placed at the annular strap 110 may be put into a certain depth in the water when the wearer is engaging in any water activity. Subsequently, the level of water or a height of water may be measured based on a pressure on a surface of the water level sensor 116. Subsequently, the level of water in relation to the wearer's body is determined.

The inclination sensor 118 is configured to measure inclination data for the wearer. In an example, the inclination sensor 118 may be tilt sensors that are used to measure an inclination angle of the wearer. In an example, the inclination sensor 118 is a single-axis tilt sensor that measures angular changes of the wearer around a single axis, specifically the vertical axis. In another example, the inclination sensor 118 is a dual-axis tilt sensor that measures angular changes of the wearer around both the vertical axis and the horizontal axis. The inclination may indicate a tilt of the wearer's body relative to the water. The inclination data may include a degree of incline, providing information about the wearer's orientation in the water.

Further, the inflation mechanism is operable to activate, i.e., inflate, the annular strap 110. When inflated, the annular strap 110 provides additional buoyancy and safety features to the wearer of the floatation device 102. The inflation mechanism facilitates controlled and rapid inflation of the annular strap 110 when activated, particularly when facing potential drowning situation. For example, in circumstances where the wearer is at risk of drowning, the annular strap 110 may include an inflation mechanism. The inflation mechanism of the annular strap 110 may be controlled by a control unit or the processor 114. For example, the control unit or the processor 114 may control or initiate inflation of the annular strap 110 by initiating a chemical reaction or providing an ignition of a small amount of propellant through electrical charge. It may be noted that such examples of the processes used by the control unit or the processor 114 for initiating the inflation of the annular strap 110 are only exemplary and should not be construed as a limitation.

The floatation device 102 may further comprise the memory 112 to store instructions and the processor 114 to execute the stored instructions to provide flotation to the wearer in case of a drowning situation. The processor 114 is connected to the water level sensor 116 and the inclination sensor 118, for example, in a wired manner or wirelessly.

In operation, the processor 114 is configured to receive the water level data and the inclination data. The processor 114 may receive the water level data from the water level sensor 116 and the inclination data from the inclination sensor 118. The water level data may indicate a level or height of water around the wearer while the inclination data may indicate an angle of inclination of the wearer at least from the vertical axis.

In an example, the processor 114 is configured to determine a level of water in contact with the wearer based on the water level data, and an inclination of the wearer relative to a vertical axis based on the inclination data. The water level data measured in relation to the wearer's position in the water indicates a height or level of water above a location of the water level sensor 116. The water level sensor 116 being positioned on the annular strap 110, for example, at chest of the wearer. surrounding the wearer. Subsequently, the water level data may indicate the level of water above the chest of the wearer.

Further, the inclination data measured in relation to the wearer's position in the water indicates an angular change in at least the vertical axis of the wearer. The inclination data indicates a degree of tilt of the wearer relative to the vertical axis. Subsequently, the inclination data may indicate an orientation of the wearer in the water.

Thereafter, the processor is configured to determine whether the wearer is drowning based on the water level data and the inclination data. In an example, the processor 114 is configured to compare the level of water indicated by the water level data and the inclination indicated by the inclination data with corresponding predefined thresholds to ascertain whether the wearer is drowning or not. For example, the water level data indicates the level of water that may be above the chest of the wearer. To this end, if the level of water is high for a prolonged period of time, then there may be a chance that the wearer is drowning. Further, the inclination data indicates the inclination of the wearer in the water. To this end, if an angle of inclination of the wearer is high, i.e., the wearer is lying down on or horizontally immersed in the water, then there may be a chance that the wearer may be drowning.

Subsequently, if the level of water is high as well as the inclination is high for a prolonged period of time then the processor 114 may ascertain that the wearer is drowning. For example, if the level of water as well as the inclination is high for a period of time greater than or equal to a predefined time threshold, then the processor 114 may ascertain that the wearer is drowning.

In an embodiment, the annular strap 110 may also include a displacement sensor (not shown). The displacement sensor may be configured to measure displacement data of the wearer. In an example, the displacement data may indicate positional movement of the wearer. These movements may be, for example, linear or rotary.

In this regard, the processor is configured to determine whether the wearer is drowning based on the displacement data. The processor 114 is configured to receive the displacement data from the displacement sensor. For example, the displacement data may indicate horizontal movements or linear changes in position of the wearer. To this end, if the processor 114 determines that the level of water and inclination is high and the displacement of the wearer is less than a threshold for the predefined time period, then the wearer may be drowning.

Upon determining that the wearer is drowning, the processor 114 is configured to trigger the inflation mechanism to inflate the annular strap 110. The inflation mechanism may further cause the annular strap 110 to inflate to provide additional buoyancy and support to the upper region or upper body of the wearer, effectively bringing and/or keeping the upper region of the body of the wearer above the water surface. In an example, the annular strap 110 may include airbag-based inflation mechanism that may trigger inflation through chemical reaction, pressure, electrical charge, or water responses. In an example, the airbag used in the annular strap 110 may be reset or deflated, and subsequently reused, after deployment. This may contribute to overall longevity and effectiveness of the floatation device 102.

It may be noted, the predefined thresholds for comparing the water level data (i.e., level of water), inclination data (i.e., angle of inclination) and/or displacement data (i.e., displacement) may serve as a reference points. The predefined thresholds may be predefined by a manufacturing entity associated with the floatation device 102. Alternatively, the predefined thresholds may be predefined by a using entity, such as the wearer of the floatation device 102.

FIG. 2 is a schematic illustration of a network environment 200 in which a system 202 for floatation assistance is implemented, in accordance with an example embodiment of the present disclosure. FIG. 2 is explained in conjunction with FIG. 1. The network environment 200 may include the system 202 and an alert device 204 connected via a communication network 206. The wearer may utilize the floatation device 102 by wearing it to achieve buoyancy and float in the water.

As described in conjunction with FIG. 1, the floatation device 102 includes the floatation member 104 that may extend around the lower region (for example, waist) of the wearer, the pair of straps 106 and 108 that may get support on the shoulders of the wearer, and the annular strap 110 that may extend across the upper region (for example, chest) of the wearer. The annular strap 110 may also include the water level sensor 116 to measure the water level data and the inclination sensor 118 to measure the inclination data.

Further, the system 202 includes the memory 112 and the processor 114. In an example, the system 202 may also include an I/O interface 208 and a communication interface 210. For example, the memory 112, the processor 114, the I/O interface 208 and the communication interface 210 are provided at the annular strap 110 of the floatation device 102. Subsequently, although shown separately, in some embodiments, the floatation device 102 may include the memory 112, the processor 114, the I/O interface 208 and the communication interface 210.

The processor 114 may be connected to the memory 112, the water level sensor 116, and the inclination sensor 118, the I/O interface 208 and the communication interface 210 through one or more wired or wireless connections. For example, the system 202 includes the floatation member 102, the processor 114, the memory 112, the I/O interface 208, and the communication interface 210, however, the disclosure may not be so limiting and the system 102 may include fewer or more components to perform the same or other functions of the system 102.

The processor 114 of the system 202 may be configured to perform one or more operations associated with providing floatation assistance. The processor 114 may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application-specific integrated circuit), an FPGA (field programmable gate array), a microcontroller unit (MCU), a hardware accelerator, a special-purpose computer chip, or the like. As such, in some embodiments, the processor 114 may include one or more processing cores configured to perform independently. A multi-core processor may enable multiprocessing within a single physical package. Additionally, or alternatively, the processor 114 may include one or more processors configured in tandem via the bus to enable independent execution of instructions, pipelining, and/or multithreading. Additionally, or alternatively, the processor 114 may include one or more processors capable of processing large volumes of workloads and operations to provide support for big data analysis. In an example embodiment, the processor 114 may be in communication with the memory 112 via a bus for passing information among components of the system 202.

For example, when the processor 114 may be embodied as an executor of software instructions, the instructions may specifically configure the processor 114 to perform the algorithms and/or operations described herein when the instructions are executed. However, in some cases, the processor 114 may be a processor-specific device (for example, a mobile terminal or a fixed computing device) configured to employ an embodiment of the present disclosure by further configuration of the processor 114 by instructions for performing the algorithms and/or operations described herein. The processor 114 may include, among other things, a clock, an arithmetic logic unit (ALU), and logic gates configured to support the operation of the processor 114.

The memory 112 may be non-transitory and may include, for example, one or more volatile and/or non-volatile memories. In other words, for example, the memory 112 may be an electronic storage device (for example, a computer readable storage medium) comprising gates configured to store data (for example, bits) that may be retrievable by a machine (for example, a computing device like the processor 114). The memory 112 may be configured to store information, data, content, applications, instructions, or the like, for enabling the system 202 to carry out various operations in accordance with embodiments of the present disclosure. For example, the memory 112 may be configured to buffer input data for processing by the processor 114. The memory 112 may be configured to store instructions for execution by the processor 114.

As such, whether configured by hardware or software methods, or by a combination thereof, the processor 114 may represent an entity (for example, physically embodied in circuitry) capable of performing operations according to an embodiment of the present disclosure while configured accordingly. Thus, for example, when the processor 114 is embodied as an Application Specific Integrated Circuit (ASIC), Field Programmable Gate Array (FPGA), or the like, the processor 114 may be specifically configured hardware for conducting the operations described herein. In an embodiment, memory 112 may be configured to store the water level data, and the inclination data, among other data generated during execution of the operations or instruction by the processor 114 for providing floatation assistance using the floatation device 102.

In some example embodiments, I/O interface 208 may communicate with the system 202 and input and/or output devices, such as display, keyboard, and mouse of the system 202. As such, the I/O interface 208 may include a display and/or a speaker and, in some embodiments, may also include a keyboard, a mouse, a touch screen, touch areas, soft keys, or other input/output mechanisms. In one embodiment, the system 202 may include a user interface circuitry configured to control at least some functions of one or more I/O interface elements such as the display and, in some embodiments, a plurality of speakers, a ringer, one or more microphones and/or the like. The processor 114 and/or I/O interface 208 circuitry including the processor 114 may be configured to control one or more operations of one or more I/O interface elements through computer program instructions (for example, software and/or firmware) stored on the memory 112 accessible to the processor 114.

Further, communication interface 210 may include an input interface and an output interface for supporting communications to and from the system 202 or any other component with which the system 202 may communicate. The communication interface 210 may be any means such as a device or circuitry embodied in either hardware or a combination of hardware and software that is configured to receive and/or transmit data to/from a communications device in communication with the system 202. In this regard, the communication interface 210 may include, for example, an antenna (or multiple antennae) and supporting hardware and/or software for enabling communications with a wireless communication network 206. Additionally, or alternatively, the communication interface 210 may include the circuitry for interacting with the antenna(s) to cause transmission of signals via the antenna(s) or to handle receipt of signals received via the antenna(s). In some environments, the communication interface 210 may alternatively or additionally support wired communication. As such, for example, the communication interface 210 may include a communication modem and/or other hardware and/or software for supporting communication via cable, digital subscriber line (DSL), universal serial bus (USB), or other mechanisms.

The communication interface 210 of the system 202 may be used to access a communication network 206. The communication network 206 may include a communication medium through which the system 202 and, for example, an alert device 204 may communicate with each other. The communication network 206 may be one of a wired connection or a wireless connection. Examples of the communication network 206 may include, but are not limited to, the Internet, a cloud network, a Wireless Fidelity (Wi-Fi) network, a Personal Area Network (PAN), a Local Area Network (LAN), or a Metropolitan Area Network (MAN). Various devices in the network environment 200 may be configured to connect to the communication network 206 in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), a device to device communication, cellular communication protocols, and Bluetooth (BT) communication protocols.

In an embodiment, the annular strap 110 of the floatation device 102 may include an alert mechanism. The alert mechanism is operable to trigger or produce an automatic signal, such as a display and/or a sound indicating warning of danger. For example, the alert mechanism may trigger an alarm, a warning signal, a flashy visual signal, or a combination thereof. In particular, the processor 114 is configured to trigger the alert mechanism based on the triggering of the inflation mechanism.

In operation, the processor 114 is configured to receive the water level data from the water level sensor 116 and the inclination data from the inclination sensor 118. For example, the water level data may indicate the level or height of water above the upper region, such as the chest of the wearer. Moreover, the inclination data may indicate an angle of inclination of the wearer in the water.

Further, the processor 114 is configured to determine whether the wearer is drowning based on the water level data and the inclination data. In this regard, the processor 114 is configured to perform a comparison between the level of water in contact with the wearer and a first threshold. Moreover, the processor 114 is configured to perform a comparison between the inclination of the wearer and a second threshold. For example, when the level of water in contact with the wearer is greater than the first threshold, it may indicate that the wearer is submerged or substantially submerged in the water. Moreover, when the inclination or the angle of inclination of the wearer is greater than the second threshold, it may indicate that the wearer is lying down or flat on a surface or inside of the water.

Subsequently, the processor 114 is configured to determine whether the level of water is greater than the first threshold and/or the inclination is greater than the second threshold based on the comparison. For example, if the level of water is greater than the first threshold, i.e., the height of water above the wearer's chest is high, and the inclination is greater than the second threshold, i.e., the wearer's chest is tilted in the water, then the processor 114 may determine that the wearer may be either engaging in a water activity (such as swimming) or drowning.

Further, to ascertain that the wearer is drowning, the processor 114 is configured to continually retrieve the water level data and the inclination data for at least a predefined time threshold. For example, the processor 114 is configured to monitor the water level data and the inclination data during a time period. The time period may start when the processor 114 first determines that the level of water is greater than the first threshold and/or the inclination is greater than the second threshold, and the time period may end at the predefined time threshold. For example, during the time period, i.e., until the predefined time threshold is reached, the processor 114 is configured to check if the level of water has decreased such that it is less than the first predefined threshold, and/or the inclination has decreased such that it is less than the first predefined threshold. If the level of water and/or the inclination decreases before the completion of the predefined threshold, then the processor 114 may ascertain that the user is not drowning. However, if the level of water and/or the inclination does not decrease or further exceeds the first predefined threshold and/or the second predefined threshold, respectively, until the completion of the predefined threshold, then the processor 114 may ascertain that the user is drowning.

Subsequently, the processor 114 is configured to trigger the inflation mechanism to inflate the annular strap 110 based on the determination that the wearer is drowning. The triggering of the inflation mechanism may cause to inflate the annular strap 110. Once inflated, the annular strap 110 may provide buoyancy to the upper region of the wearer and allow them to float.

In an example, the processor 114 is further configured to trigger the alert mechanism based on the triggering of the inflation mechanism. In an embodiment, the alert mechanism is visual alert mechanism, audio alert mechanism, or a combination thereof. In an example, the audio alert mechanism may provide an audio alert, such as a siren, an indication of drowning, or any other type of alert sound. Moreover, the visual alert mechanism may provide a visual alert or cue, such as a flashing light or other visual indicators. Subsequently, the triggering of the alert mechanism in a situation where the wearer may be drowning may draw attention while reducing active vigilance required to observe the wearer when engaging in a water activity. For example, triggering the alert mechanism along with the alert mechanism ensures that the wearer does not drown as well as gets necessary attention from nearby people to provide assistance.

In an example, the alert mechanism is also configured to send an alert message, such as a push message, a notification etc. to the alert device 204. For example, the alert device 204 may be a user device associated with the wearer, a user (such as a guardian, a friend, etc.) associated with the wearer, and/or an emergency service provider (such as lifeguard, security personnel, etc.).

FIG. 3A is a schematic illustration 300A of a top view of the floatation device 102, in accordance with an example embodiment of the present disclosure. FIG. 3B is a schematic illustration 300B of a bottom view of the floatation device 102, in accordance with an example embodiment of the present disclosure. FIG. 3A and FIG. 3B are explained in conjunction with elements of FIG. 1 and FIG. 2.

As shown, the floatation device 102 comprises a floatation member 104. The floatation members 104 is shaped as a frustum, such as a flat-topped cone. Further, the circumference of the top end 104*a* is smaller than the circumference of the bottom end 104*b*. The floatation device 102 comprises the pair of straps 106 and 108. The pair of straps 106 and 108 are spaced apart such that the straps 106 and 108 can be adjustably supported on the shoulders of the wearer to secure the flotation member 104 to the wearer. In addition, the floatation device 102 comprises the annular strap 110. The annular strap 110 is a flat, thin strip of a water-resistant material that may form a loop. For example, the loop may be circular or rounded square. The annular strap 110 may go around the chest of the wearer to provide, for example, additional reinforcement to the fit of the flotation device 102 on the wearer. Moreover, the annular strap 110 includes an inflation mechanism that causes inflation of the annular strap 110 to provide emergency floatation assistance to the wearer.

In an example, the floatation device 102 further comprises a divider 302 extending along a diameter of the cavity 104*c* of the floatation member 104. The divider 302 may be a longitudinal partition made of same material as the floatation member 104. For example, the divider 302 is connected to the flotation member 104 such that the divider 302 divides the cavity 104*c* into two halves. Subsequently, each of the two halves may receive a leg of the wearer. For example, edges of the longitudinal divider 302 may be connected to an inner surface of the floatation member 104 across the diameter thereof. Further, the divider 302 prevents the bottom end 104*b* of the floatation member 104 to rise up when the wearer steps into water due to upward pressure of the water.

FIG. 4A and FIG. 4B are schematic illustrations 400A and 400B, respectively, of the inflatable annular strap 110 of the floatation device 102, in accordance with an example embodiment of the present disclosure. FIG. 4A and FIG. 4B are explained in conjunction with elements of FIG. 1, FIG. 2, FIG. 3A, and FIG. 3B.

The annular strap 110 may be a circular ring-shaped strap. The annular strap 110, when worn, may encircle the upper region, such as the chest of the wearer. The placement of the annular strap 110 around the chest of the wearer is intended to enhance buoyancy and support during emergency floatation assistance. The annular strap 110 may be made from robust, water-resistant fabrics or polymers that are capable of withstanding exposure to water, UV rays and other environmental factors.

In an example, the annular strap 110 may be supported by the pair of straps 106 and 108. Moreover, the pair of straps 106 and 108 may include adjustment means (depicted as adjustment means 404 for the strap 106 and adjustment means 406 for the strap 108. For example, the adjustment means 404 and 406 may be buckles, jaw clamps, clasps, harness, overall clips, strips of hook, loop tape etc. For example, the adjustment means 404 may be provided near the first end 106*a* of the strap 106, such that the first end 106*a* is connected to the first side of the top end 104*a* of the floatation member 104. Similarly, the adjustment means 406 may be provided near the first end 108*a* of the strap 108, such that the first end 108*a* is connected to the first side of the top end 104*a* of the floatation member 104. For example, the first side of the top end 104*a* may be towards a front side of the wearer. Subsequently, the wearer is able to adjust the adjustment means 404 and 406 in front of them to tighten or loosen the fit of the floatation device 102. To this end, the second end 106*b* of the strap 106 and the second end 108*b* of the strap 108 may be connected to the second side, such as a rear or back side of the top end 104*a* of the floatation member 104.

Referring to FIG. 4A, the annular strap 110 may include the water level sensor 116 and the inclination sensor 118. In an example, the processor 114 for processing the water level data received from the water level sensor 116 and the inclination data received from the inclination sensor 118 may be positioned locally on the floatation device 102, such as at the annular strap 110. In addition, the memory 112 to store the water level data, the inclination data, and/or other data may also be positioned locally on the floatation device 102 at the annular strap 110.

In an embodiment, the annular strap 110 may also include a displacement sensor 402. The displacement sensor 402 may be configured to measure displacement data indicating the horizontal and/or vertical movement in position of the annular strap 110, and, consequently, the wearer.

Referring to FIG. 4B, the annular strap 110 is inflated. For example, when the processor 114 determines that the wearer is drowning, then the processor 114 may trigger the inflation mechanism of the annular strap 110. The processor 114 is configured to determine that the wearer is drowning based on the water level data, the inclination data, and the displacement data. A manner in which the processor 114 ascertains that the wearer is drowning is described in detail in conjunction with FIG. 1 and FIG. 2.

The inflation of the annular strap 110 is a responsive action triggered by the processor 114 upon determining drowning scenarios. In an example, the inflation mechanism of the annular strap 110 may include an airbag that inflates into a tube-like structure 408 that envelops and covers the chest of the wearer. The inflation mechanism ensures that the annular strap 110 is rapidly inflated, creating a buoyant barrier around the wearer's chest to provide essential support and promote water safety in the event of the drowning scenarios.

The design of annular strap 110 may incorporate a reset feature, allowing the annular strap 110 to return to its deflated state after use. This configuration ensures that the floatation device remains usable, providing a practical solution for the users to reset the annular strap 110 and prepare it for subsequent water-related activities.

FIG. 5 is a schematic illustration 500 of the floatation device 102 when in use, in accordance with an example embodiment of the present disclosure. FIG. 5 is explained in conjunction with elements of FIG. 1, FIG. 2, FIG. 3A, FIG. 3B, FIG. 4A, and FIG. 4B.

As shown, a wearer 502 is wearing the floatation device 102 to augment buoyancy during water-related activities. In an example, the wearer 502 may be a child who is learning to swim. In another example, the wearer 502 may be an adult that may be engaging in water activities. For example, the floatation device 102 may be made in different sizes for different age groups of wearers. Further, the adjustments means 404 and 406 may enable adjustment of the floatation device 102 on different body shapes of the wearer 502.

For example, on determining that the wearer 502 is downing, the processor 114 is configured to trigger the inflation mechanism. Further, the inflation mechanism may cause to swiftly inflate the annular strap 110. In one example, the inflation mechanism is operable to trigger a chemical reaction using an electrical charge to cause rapid inflation for inflating the annular strap 110. In another example, the inflation mechanism is operable to utilize a compressed air canister to inflate the annular strap 110 quickly. This canister may be replaced after the inflation. In yet another example, the inflation mechanism is operable to utilize a carbon dioxide cartridge inflator to inflate the annular strap 110 quickly. This cartridge inflator may be replaced after the inflation.

In an example, the floatation device 102 includes an alert mechanism to generate an alert, such as a visual alert or an audio alert, to indicate submersion or drowning of the wearer 502, when the inflation mechanism is triggered.

FIG. 6 is a flowchart 600 that illustrates an exemplary method for providing floatation assistance, in accordance with an embodiment of the disclosure. FIG. 6 is explained in conjunction with elements from FIG. 1, FIG. 2, FIG. 3A, FIG. 3B, FIG. 4A, FIG. 4B and FIG. 5. The operations described in the flowchart 600 may be performed or executed by any computing system, for example, by the processor 114 of FIG. 1 The operations of the flowchart 600 may start at 602.

At 602, water level data from the water level sensor 116 and inclination data from the inclination sensor 118 are received. In an example, the processor 114 is configured to receive the real-time water-level data from the water level sensor 116. The water level data may indicate a level of water above the sensor 116, such as above the strap 110 and above the chest of the wearer 502. Further, the processor 114 is configured to receive the real-time inclination data from the inclination sensor 118. The inclination data may indicate an inclination of an angle of tilt or incline of the chest of the wearer 502 from a vertical axis, thereby indicating if the chest of the wearer 502 is lying flat on the water or the chest of the wearer 502 is vertically upward.

At 604, whether the wearer 502 is drowning is determined based on the water level data and the inclination data. In an example, the processor 114 is configured to compare the level of water indicated by the water level data with the first predefined threshold and compare the inclination indicated by the inclination data with the second predefined threshold. For example, if the level of water is greater than the first predefined threshold and the inclination is greater than the second predefined threshold continually until the predefined time threshold is reached, then the processor 114 may ascertain that the wearer 502 is drowning.

At step 606, the inflation mechanism to inflate the annular strap 110 is triggered based on determining that the wearer is drowning. In an example, the processor 114 is configured to trigger the inflation mechanism of the annular strap 110 that causes to inflate the annular strap 110 when the processor 114 determines that the wearer 502 is drowning. The inflation of the annular strap 110 may provide buoyancy to the upper region of the body of the wearer 502 effectively bringing the upper region afloat or at the water surface to prevent submersion.

In an embodiment, the processor 114 is configured to trigger the alert mechanism based on the triggering of the inflation mechanism to provide alarm about the potential drowning so that nearby people may take necessary action.

Accordingly, blocks of the flowchart 600 support combinations of means for performing the specified functions and combinations of operations for performing the specified functions. It will also be understood that one or more blocks of the flowchart 600, and combinations of blocks in the flowchart 600, can be implemented by special-purpose hardware systems which perform the specified functions, or combinations of special-purpose hardware.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of reactants and/or functions, it should be appreciated that different combinations of reactants and/or functions may be provided by alternative embodiments without departing from the scope of the appended claims. In this regard, for example, different combinations of reactants and/or functions than those explicitly described above are also contemplated as may be set forth in some of the appended claims. Although specific terms are employed herein, they are used in a generic and descriptive sense only and not for purposes of limitation.

What is claimed is:

1. A floatation device comprising:

a frustoconical floatation member defining a cavity to receive a lower region of a wearer, the floatation member having a top end and a bottom end opposite to the top end;

a pair of straps having a first end and an opposing second end, wherein the first end is connected to a first side of the top end and the second end is connected to a second side of the top end, and wherein the first side is opposite to the second side;

an inflatable annular strap to extend around an upper region of the wearer, the annular strap comprising an inflation mechanism and at least a water level sensor to measure water level data and an inclination sensor to measure inclination data;

a memory to store instructions; and a processor connected to the water level sensor and the inclination sensor, wherein the processor is configured to execute the instructions to: receive the water level data and the inclination data, determine whether the wearer is drowning based on the water level data and the inclination data, and trigger the inflation mechanism to inflate the annular strap based on determining that the wearer is drowning.

2. The floatation device of claim 1, wherein the annular strap further comprises a displacement sensor to measure displacement data, and wherein the processor is configured to determine whether the wearer is drowning based on the displacement data.

3. The floatation device of claim 1, wherein a circumference of the top end is smaller than a circumference of the bottom end, and wherein the upper region of the wearer is closer to the top end than the bottom end.

4. The floatation device of claim 1, further comprising a divider extending along a diameter of the cavity and coupled to the floatation member, wherein the divider divides the cavity into two halves.

5. The floatation device of claim 1, wherein the frustoconical floatation member defines the cavity to receive legs of the wearer.

6. The floatation device of claim 1, wherein the inflatable annular strap extends around a chest of the wearer.

7. The floatation device of claim 1, wherein the pair of straps is adapted to be adjustably supported on shoulders of the wearer to secure the floatation member to the wearer.

8. The floatation device of claim 1, wherein the processor is configured to:

determine at least one of: a level of water in contact with the wearer based on the water level data, or an inclination of the wearer relative to a vertical position based on the inclination data.

9. The floatation device of claim 8, wherein the processor is configured to:

perform at least one of: a comparison between the level of water in contact with the wearer and a first threshold, or a comparison between the inclination of the wearer and a second threshold;

determine whether at least one of: the level of water is greater than the first threshold, or the inclination is greater than the second threshold, based on the comparison; and trigger the inflation mechanism to inflate the annular strap based on the determination and a predefined time threshold.

10. The floatation device of claim 1, wherein the annular strap further comprises an alert mechanism, and wherein the processor is configured to:

trigger the alert mechanism based on the triggering of the inflation mechanism.

11. The floatation device of claim 1, wherein the alert mechanism is based on at least one of: visual alert mechanism, or audio alert mechanism.

12. A method for floatation assistance implemented using a floatation device comprising:

a frustoconical floatation member defining a cavity to receive a lower region of a wearer, the floatation member having a top end and a bottom end opposite to the top end, a pair of straps having a first end and an opposing second end, wherein the first end is connected to a first side of the top end and the second end is connected to a second side of the top end, and wherein the first side is opposite to the second side, and an inflatable annular strap to extend around an upper region of the wearer, the annular strap comprising an inflation mechanism and at least a water level sensor to measure water level data and an inclination sensor to measure inclination data, wherein the method comprises:

receiving the water level data from the water level sensor and the inclination data from the inclination sensor;

determining whether the wearer is drowning based on the water level data and the inclination data; and triggering the inflation mechanism to inflate the annular strap based on determining that the wearer is drowning.

13. The method of claim 12, wherein the annular strap further comprises a displacement sensor to measure displacement data, and wherein the method further comprises:

determining whether the wearer is drowning based on the displacement data.

14. The method of claim 12, further comprising:

determining at least one of: a level of water in contact with the wearer based on the water level data, or an inclination of the wearer relative to a vertical position based on the inclination data.

15. The method of claim 14, further comprising:

performing at least one of: a comparison between the level of water in contact with the wearer and a first threshold, or a comparison between the inclination of the wearer and a second threshold;

determining whether at least one of: the level of water is greater than the first threshold, or the inclination is greater than the second threshold, based on the comparison; and triggering the inflation mechanism to inflate the annular strap based on the determination and a predefined time threshold.

16. The method of claim 12, wherein the annular strap further comprises an alert mechanism, and wherein the processor is configured to:

trigger the alert mechanism based on the triggering of the inflation mechanism.

17. A system for floatation assistance comprising:

a memory for storing instructions; and a processor configured to the execute the instructions that cause the processor to:

receive water level data from a water level sensor and inclination data from an inclination sensor, wherein the water level sensor and the inclination sensor are provided in an inflatable annular strap of a floatation device that extends around an upper region of a wearer, wherein the annular strap comprises an inflation mechanism, and wherein the floatation device comprises a frustoconical floatation member having a top end and a bottom end opposite to the top end and defining a cavity to receive a lower region of the wearer, and a pair of straps having a first end and an opposing second end such that the first end is connected to a first side of the top end and the second end is connected to a second side opposite to the first side of the top end;

determine whether the wearer is drowning based on the water level data and the inclination data; and trigger the inflation mechanism to inflate the annular strap based on determining that the wearer is drowning.

18. The system of claim 17, wherein the annular strap further comprises a displacement sensor to measure displacement data, and wherein the processor is configured to:

receive displacement data from the displacement sensor; and determine whether the wearer is drowning based on the displacement data.

19. The system of claim 17, wherein the processor is configured to:

determine at least one of: a level of water in contact with the wearer based on the water level data, or an inclination of the wearer relative to a vertical position based on the inclination data.

20. The system of claim 19, wherein the processor is configured to:

perform at least one of: a comparison between the level of water in contact with the wearer and a first threshold, or a comparison between the inclination of the wearer and a second threshold;

determine whether at least one of: the level of water is greater than the first threshold, or the inclination is greater than the second threshold, based on the comparison; and trigger the inflation mechanism to inflate the annular strap based on the determination and a predefined time threshold.

* * * * *